United States Patent [19]

Kochackis

[11] 4,350,032

[45] Sep. 21, 1982

[54] VENDING MACHINE LOCK SECURITY COVER

[76] Inventor: Donald G. Kochackis, E. Prospect St., Chula Vista, Calif. 92011

[21] Appl. No.: 181,075

[22] Filed: Aug. 25, 1980

[51] Int. Cl.[3] ..... E05B 17/18

[52] U.S. Cl. ..... 70/427; 70/159; 70/161; 70/DIG. 63

[58] Field of Search ..... 70/158–164, 70/423, 424, 427, 428, 419, 416–418, DIG. 63

[56] References Cited

U.S. PATENT DOCUMENTS

| | | | |
|---|---|---|---|
| 3,714,804 | 2/1973 | French | 70/423 X |
| 3,765,199 | 10/1973 | Wiczer | 70/423 |
| 3,903,721 | 9/1975 | Aaron | 70/423 |
| 4,044,579 | 8/1977 | Le Bel | 70/427 X |
| 4,066,307 | 1/1978 | Barding | 70/423 X |

*Primary Examiner*—William E. Lyddane

*Attorney, Agent, or Firm*—Henri J. A. Charmasson

[57] ABSTRACT

A security cover is provided for the lock boxes of vending machine doors and the like wherein a bracket is mounted around the keyway and a closure is hinged to the bracket such that it will swing shut defining an enclosure and can be locked in this closed position with a lock that is accessible only from within the enclosure, there being an opening in the enclosure, preferably through the closure member, permitting access to this locking means to free the closure, thereby providing access to the door lock.

7 Claims, 7 Drawing Figures

VENDING MACHINE LOCK SECURITY COVER

BACKGROUND

As crime mounts and successful prosecution of criminals becomes increasingly difficult, any machine or device accessible to the public which contains cash, or even appears as though it might contain cash, stands a high risk of being forced open. To make this more difficult numerous devices have been developed, most of which serve as a prophylactic between the machine and the public which is secured by yet another lock. Such a device causes the would-be burgler to break into two locked devices instead of one, and undoubtedly slows him down to a certain extent, especially if the first lock and the protective cover device are made in heavy-guage metal.

However, nonetheless many of these systems merely induce the lock picker or forcer to engage his talents twice rather than once but with the same result. There is a need therefore for a simple and economical vending machine door lock security cover much along the lines just described but which makes it much more difficult if not impossible for the criminal to pick or force the second lock means.

SUMMARY

The above-stated need is filled by the instant invention which comprises a bracket which mounts around the key hole opening in the door of a vending machine. There are two different embodiments illustrated, but both work substantially on the principal of utilizing a hinged cover which swings over the door lock and has a lock mounted on the inside thereof which will lock the hinged closure to the bracket to define an enclosed space, this space being accessible through an opening in the closure. A lock within the closure holds the closure shut and can be unlocked only by one inserting fingers through the opening with a key and inserting it in the lock means back toward the body of the operator rather than forwardly as is usually the case.

Thus one bent on picking the lock would be required to pick it not only backwards, but blind, and inadequate space is provided around the closure locking means to permit forcing this lock with a crowbar or heavy-gage metal cutters.

DETAILED DESCRIPTION OF THE PREFERRED EMBODIMENTS

Figure 1:
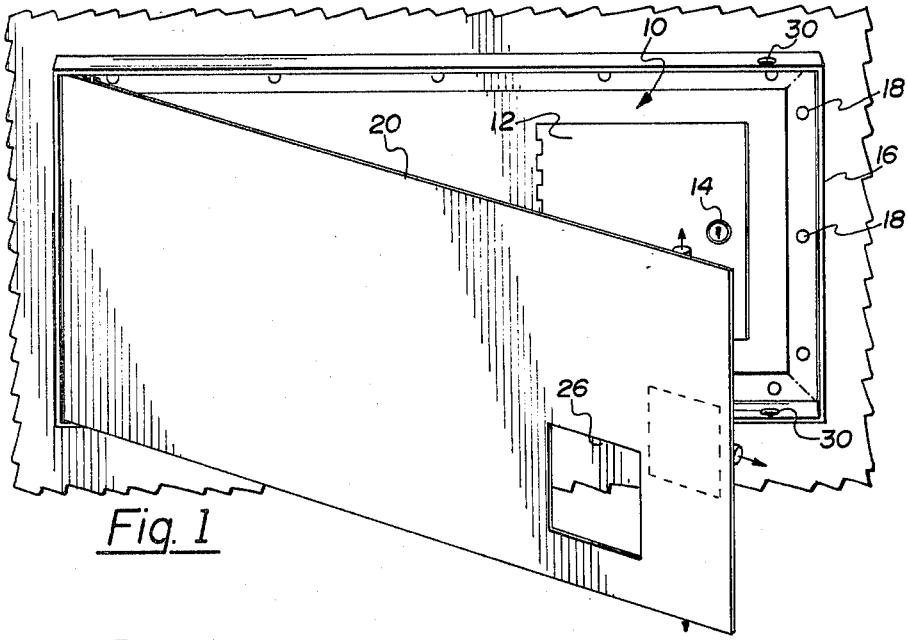
FIG. 1 is a perspective view of a cover with the door partially open.
Figure 2:
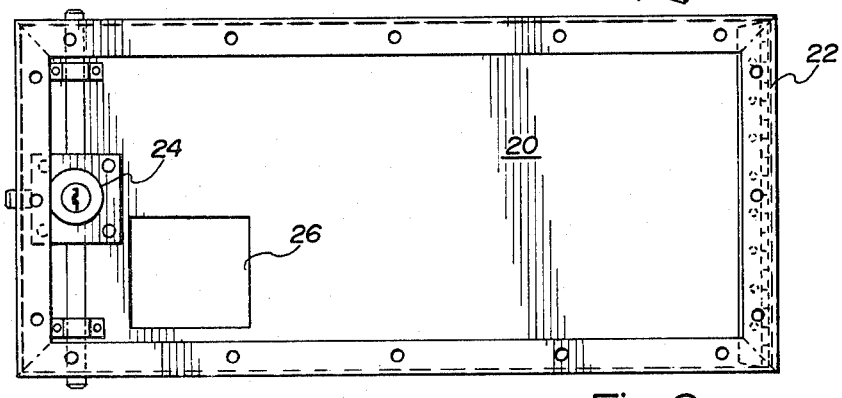
FIG. 2 is a view from inside the enclosure looking at the closure door.

A portion of a vending machine is shown at 10 wherein a conventional front cover or door 12 utilizes a key operated lock 14 accessible from the front. Burglers get through the front cover or door in one of two ways ordinarily. First, they pick the lock 14, which is not terribly difficult to do. Second, for those that lack the sophistication for the picking technique, a strong screwdriver or crowbar is inserted past the edge of the door and the door is forced open.

The instant invention in one embodiment utilizes a bracket 16 which is in the form of an angle iron and defines the frame of the device. This frame is fastened to the vending machine with rivets 18 or other fasteners which are preferably not easily removable, although they are not accessible due to the fitting of the closure door 20 which is hinged in the bracket 16 at 22.

Figure 3:
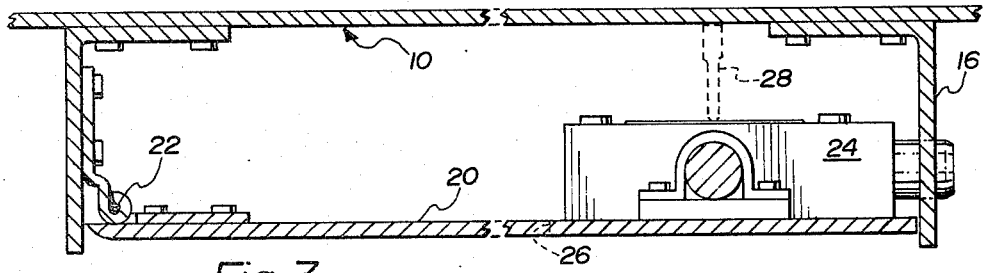
FIG. 3 is a section taken horizontally through the device with the door shut, and with portions removed.

At the non-hinged end of the closure door 20 is a three-bolt dead bolt lock 24 which it will be noted faces reardly, or away from the operator. Adjacent this lock is a rectangular opening 26 through which the operator can insert his fingers to open the lock with a key, shown in phantom at 28 in FIG. 3, which preferably barely fits between the front face of the vending machine and the dead bolt lock. Striker plates for the dead bolts are established by holes 30 cut in the bracket 16. The brackets at these points might be mader thicker so that the holes don't penetrate the brackets and the dead bolts are not extremely accessible for forcing.

The conventional way in which a lock is picked is a two-handed method wherein a picking device is inserted with one hand to raise one tumbler at a time, and a "tension wrench" is used with the other hand to apply a rotary pressure on the lock cylinder. When the tumbler is correctly aligned, a very slight movement can be felt on the tension wrench by an experienced lock picker and the slight twisting of the cylinder provided by the tension wrench holds one tumbler in place while subsequent tumblers are similarly positioned.

Lock picking is a delicate art requiring full access with both hands and the ability to see what one is doing. Except with the use of unimaginably bizarre picking means it would be impossible to even come close to picking the lock 24, as it would have to be done blind, backwards, and one-handed. It is therefore for purposes of the present discussion, pick-proof.

Forcing of the door is prevented by means of the peripheral bracket 16 which prevents entry of a crowbar or screwdriver between the door and its framing member. Naturally this is most effective if the door and bracket are rather tightly fitted.

Figure 4:
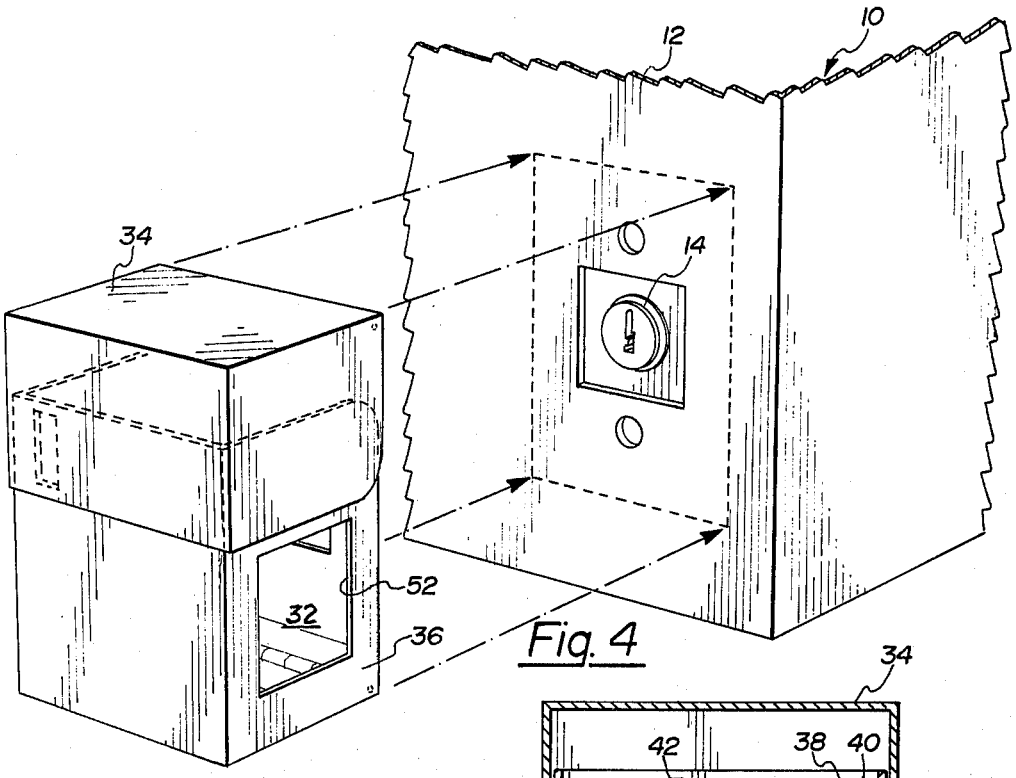
FIG. 4 is a perspective view of a modification of the device illustrating its mounting over a vending machine door.
Figure 6:
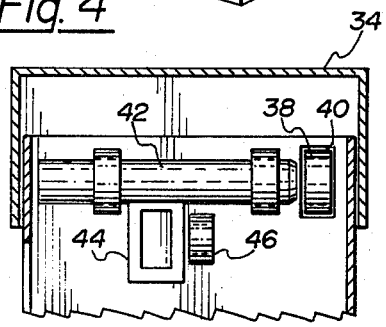
FIG. 6 is a detail of the locking mechanism of the device looking forwardly when it is closed.
Figure 5:
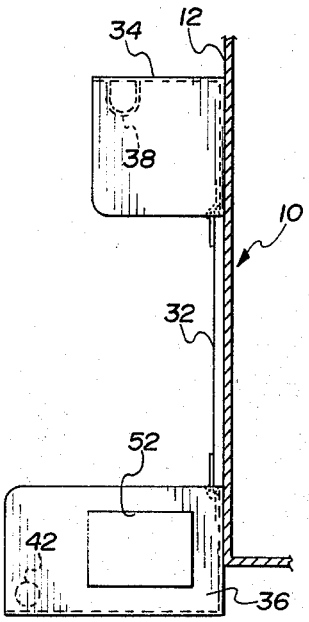
FIG. 5 is a side elevation view of the device of FIG. 4 in its open position.
Figure 7:
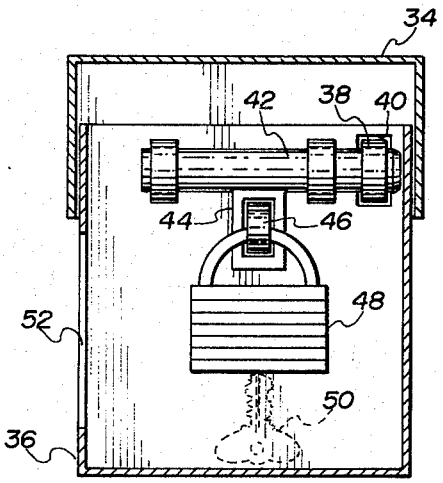
FIG. 7 is an elevation view similar to FIG. 6 but with the bolt locked in its locked position.

A modification of the device is shown in FIGS. 4 through 7 wherein the frame includes a bracket 32 having a top hinge and an upper box-like enclosure 34. This enclosure is open at two faces and mates with the lower closure means 36 as shown in FIGS. 4 and 6 and a metal loop 38 in the box-like closure member 34 passes through the slot 40 in the lower member 34. Mounted to the inside of the lower closure member 36 is a bolt 42 having a hasp 44 which is secured over a second metal loop 46 by means of padlock 48. This padlock is operated by a key 50 and the only access to the paklock is through an opening 52 in the side of the closure member. The side for the opening, and the positioning of the padlock, are subject to modification to compromise ease of opening versus difficulty of picking.

It would be possible of course to utilize other locks in either of the embodiments shown, such as a padlock in the first embodiment or a fixed lock in the second embodiment. With these or any of a number of minor modifications the security cover provides security against theft from a higher level of criminal than does the conventional door lock cover.

An unprotected vending machine can be robbed by any amateur who has a good screwdriver. A vending machine protected by prior art cover devices described above ordinarily cannot be picked by anyone with a screwdriver, but can be picked by one with a heavy-guage bolt cutter, crowbars adapted for the purpose, or one having moderate skill as a lock pick, and people of this sophistication abound.

The present invention puts the machine beyond the reach of all the above-described criminals. Although the device or piece of machinery known to man can be eventually broken, opened or destroyed as the sophistication of equipment is increased, the cover mechanism disclosed and claimed herein is effectively beyond the operative range of either amateur or professional burglers.

I claim:

1. A security cover for the lock of a vending machine or the like comprising:

(a) a frame and means mounting same over said lock;

(b) a closure moveably mounted on said frame and being moveable thereon from an open position providing substantial access to said lock to a closed position covering said lock and defining an enclosure;

(c) locking means disposed within said enclosure for locking said enclosure to said frame and being operative from inside said enclosure;

(d) said cover defining an opening misaligned with said locking means and the keyhole of said lock to prevent the direct picking thereof and being adequately large to permit the insertion of the fingers to operate said locking means.

2. Structure according to claim 1 wherein said closure is generally planar and parallel to the front face of said lock, and said locking means comprises a key-operated dead bolt lock mounted on said closure and having the key entry facing the lock, and said opening is defined in said closure adjacent said locking means, whereby one attempting to break in would have to reach through said opening and pick said locking means blind and backwards.

3. Structure according to claim 1 wherein said frame includes an angle iron defining a lip around said closure to prevent access to the edges thereof with a crowbar.

4. Structure according to claim 1 wherein said frame includes a mounting bracket and a box-like member open at two faces and hinged to one side of said bracket, and said closure comprises another box-like member open at two sides and hinged to the other side of said bracket such that said box-like members can swing together in a closed mode to define said enclosure.

5. Structure according to claim 4 wherein said members overlap when in the closed mode and one has a slot and the other has a metal loop which passes through said slot internally into said enclosure, and said locking means is engaged through said loop.

6. Structure according to claim 5 wherein said locking means comprises a padlock secured dead bolt.

7. Structure according to claim 6 wherein said opening is defined in the side of said closure.

* * * * *